US006598329B1

(12) United States Patent
Alexander

(10) Patent No.: US 6,598,329 B1
(45) Date of Patent: Jul. 29, 2003

(54) TACTICAL WEAPON

(76) Inventor: James M. Alexander, 4750 Libbey Rd., Perrysburg, OH (US) 43551

( * ) Notice: Subject to any disclaimer, the term of this patent is extended or adjusted under 35 U.S.C. 154(b) by 0 days.

(21) Appl. No.: 09/960,062

(22) Filed: Sep. 21, 2001

(51) Int. Cl.[7] ..... F41C 23/00; F41A 21/00; F41G 1/00

(52) U.S. Cl. ..... 42/71.01; 42/73; 42/76.01; 42/114

(58) Field of Search ..... 42/71.01, 72, 73, 42/75.04, 76.01

(56) References Cited

U.S. PATENT DOCUMENTS 1,386,247 A * 8/1921 Fordyce ..... 42/69.01
2,472,804 A * 6/1949 Bird ..... 42/72
2,771,697 A * 11/1956 Reising ..... 427/71.01
2,826,848 A * 3/1958 Davies ..... 42/71.01
3,369,316 A * 2/1968 Miller ..... 42/72
4,327,626 A 5/1982 McQueen
4,579,034 A * 4/1986 Holloway ..... 42/18
4,677,781 A * 7/1987 Lee ..... 42/70.01
4,695,256 A * 9/1987 Eichweber ..... 434/20
4,759,145 A 7/1988 Volansky
4,827,652 A * 5/1989 Martin ..... 42/142
4,878,305 A * 11/1989 Gabrielidis ..... 42/118
D324,557 S 3/1992 Livingston
5,628,137 A 5/1997 Cortese
5,675,112 A 10/1997 Giry et al.
6,070,355 A 6/2000 Day
6,397,507 B1 * 6/2002 Marshall et al. ..... 42/106

FOREIGN PATENT DOCUMENTS

FR 2686152 A3 * 7/1993 ..... F41C/7/11

* cited by examiner

*Primary Examiner*—Charles T. Jordan
*Assistant Examiner*—Tara M Golba

(57) ABSTRACT

A tactical weapon includes a firearm assembly that is for firing ammunition. The firearm assembly has a stock member. The stock member is for facilitating supporting of the firearm assembly by a user. The stock member has a butt portion. The butt portion is coupled to a main portion of the stock member such that the butt portion is selectively positionable with respect to the main portion of the stock member. The butt portion is for permitting the user to position the firearm assembly around an object. A handle member is coupled to the firearm assembly. The handle member is selectably positionable with respect to the firearm assembly such that the handle member is for permitting the user to position the firearm assembly around the object.

15 Claims, 3 Drawing Sheets

TACTICAL WEAPON

BACKGROUND OF THE INVENTION

1. Field of the Invention

The present invention relates to firearms and more particularly pertains to a new tactical weapon for allowing a user point the weapon around or over a wall without exposing the user's hands to incoming fire.

2. Description of the Prior Art

The use of firearms is known in the prior art. More specifically, firearms heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 6,070,355; 5,628,137; 4,327,626; 5,675,112; Des. 324,557; and 4,759,145.

While these devices fulfill their respective, particular objectives and requirements, the aforementioned patents do not disclose a new tactical weapon. The inventive device includes a firearm assembly that is adapted for firing ammunition. The firearm assembly has a stock member. The stock member is adapted for facilitating supporting of the firearm assembly by a user. The stock member has a butt portion. The butt portion is coupled to a main portion of the stock member such that the butt portion is selectively positionable with respect to the main portion of the stock member. The butt portion is adapted for permitting the user to position the firearm assembly around an object. A handle member is coupled to the firearm assembly. The handle member is selectably positionable with respect to the firearm assembly such that the handle member is adapted for permitting the user to position the firearm assembly around the object.

In these respects, the tactical weapon according to the present invention substantially departs from the conventional concepts and designs of the prior art, and in so doing provides an apparatus primarily developed for the purpose of allowing a user to point the weapon around or over a wall without exposing the user's hands to incoming fire.

SUMMARY OF THE INVENTION

In view of the foregoing disadvantages inherent in the known types of firearms now present in the prior art, the present invention provides a new tactical weapon construction wherein the same can be utilized for allowing a user to point the weapon around or over a wall without exposing the user's hands to incoming fire.

The general purpose of the present invention, which will be described subsequently in greater detail, is to provide a new tactical weapon apparatus and method which has many of the advantages of the firearms mentioned heretofore and many novel features that result in a new tactical weapon which is not anticipated, rendered obvious, suggested, or even implied by any of the prior art firearms, either alone or in any combination thereof.

To attain this, the present invention generally comprises a firearm assembly that is adapted for firing ammunition. The firearm assembly has a stock member. The stock member is adapted for facilitating supporting of the firearm assembly by a user. The stock member has a butt portion. The butt portion is coupled to a main portion of the stock member such that the butt portion is selectively positionable with respect to the main portion of the stock member. The butt portion is adapted for permitting the user to position the firearm assembly around an object. A handle member is coupled to the firearm assembly. The handle member is selectably positionable with respect to the firearm assembly such that the handle member is adapted for permitting the user to position the firearm assembly around the object.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of he invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new tactical weapon apparatus and method which has many of the advantages of the firearms mentioned heretofore and many novel features that result in a new tactical weapon which is not anticipated, rendered obvious, suggested, or even implied by any of the prior art firearms, either alone or in any combination thereof.

It is another object of the present invention to provide a new tactical weapon, which may be easily and efficiently manufactured and marketed.

It is a further object of the present invention to provide a new tactical weapon, which is of a durable and reliable construction.

An even further object of the present invention is to provide a new tactical weapon which is susceptible of a low cost of manufacture with regard to both materials and labor, and which accordingly is then susceptible of low prices of sale to the consuming public, thereby making such tactical weapon economically available to the buying public.

Still yet another object of the present invention is to provide a new tactical weapon, which provides in the apparatuses and methods of the prior art some of the advantages thereof, while simultaneously overcoming some of the disadvantages normally associated therewith.

Still another object of the present invention is to provide a new tactical weapon for allowing a user to point the weapon around or over a wall without exposing the user's hands to incoming fire.

Yet another object of the present invention is to provide a new tactical weapon, which includes a firearm assembly that is adapted for firing ammunition. The firearm assembly has a stock member. The stock member is adapted for facilitating supporting of the firearm assembly by a user. The stock member has a butt portion. The butt portion is coupled to a main portion of the stock member such that the butt portion is selectively positionable with respect to the main portion of the stock member. The butt portion is adapted for permitting the user to position the firearm assembly around an object. A handle member is coupled to the firearm assembly. The handle member is selectably positionable with respect to the firearm assembly such that the handle member is adapted for permitting the user to position the firearm assembly around the object.

Still yet another of the present invention is to provide a new tactical weapon that would fulfill a need for and effective and affordable camera vision system and folding weapon.

Even still another object of the present invention is to provide a new tactical weapon that would provide a user a means of visual awareness to safely view and return fire while remaining safely behind cover.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
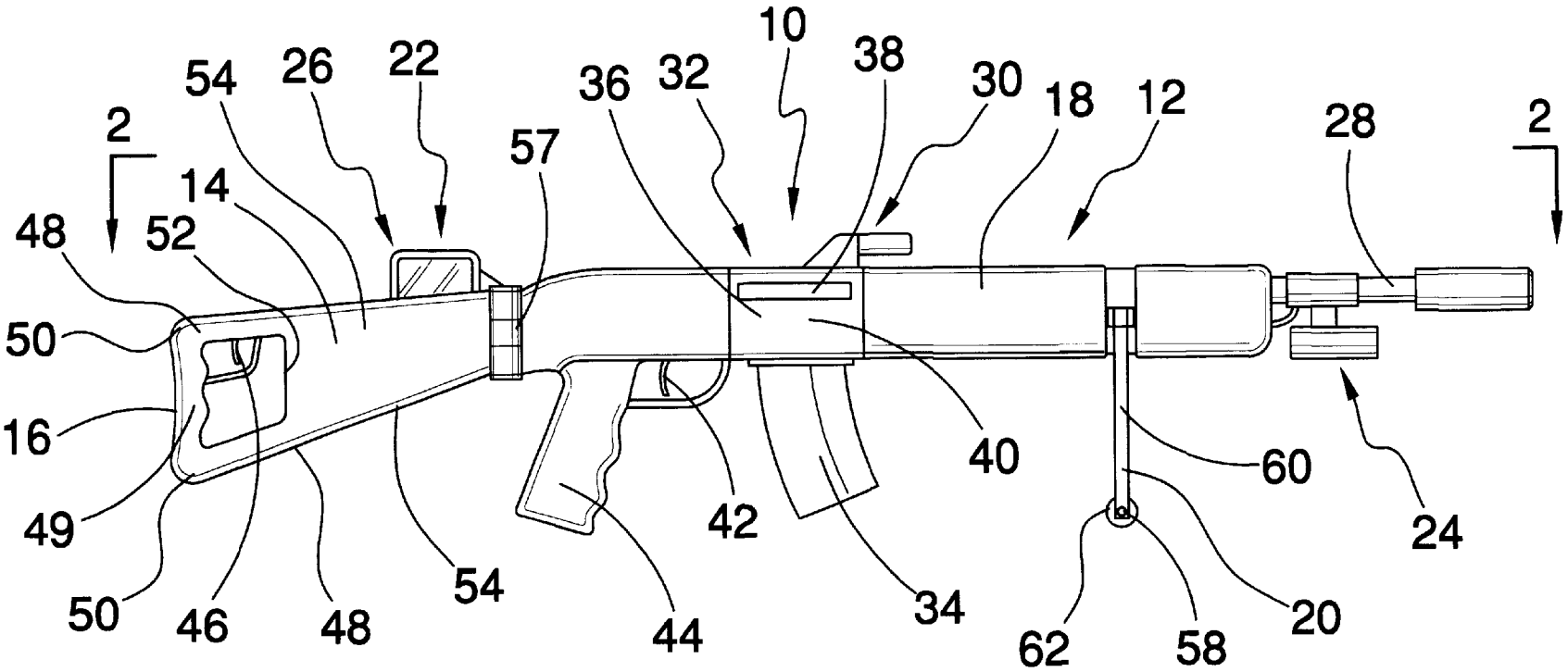
FIG. 1 is a side view of a new tactical weapon according to the present invention.
Figure 2:
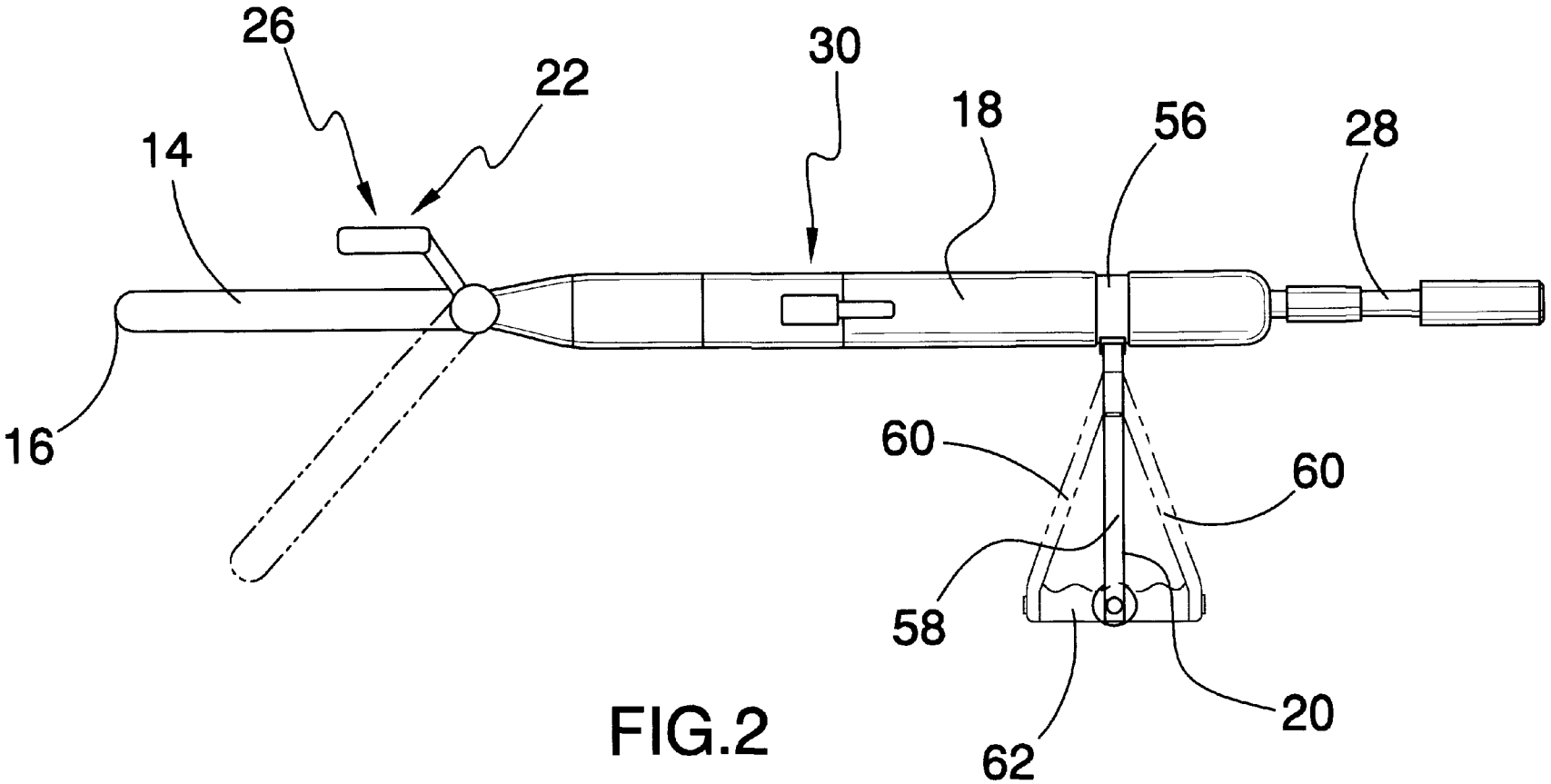
FIG. 2 is a top view of the present invention.
Figure 3:
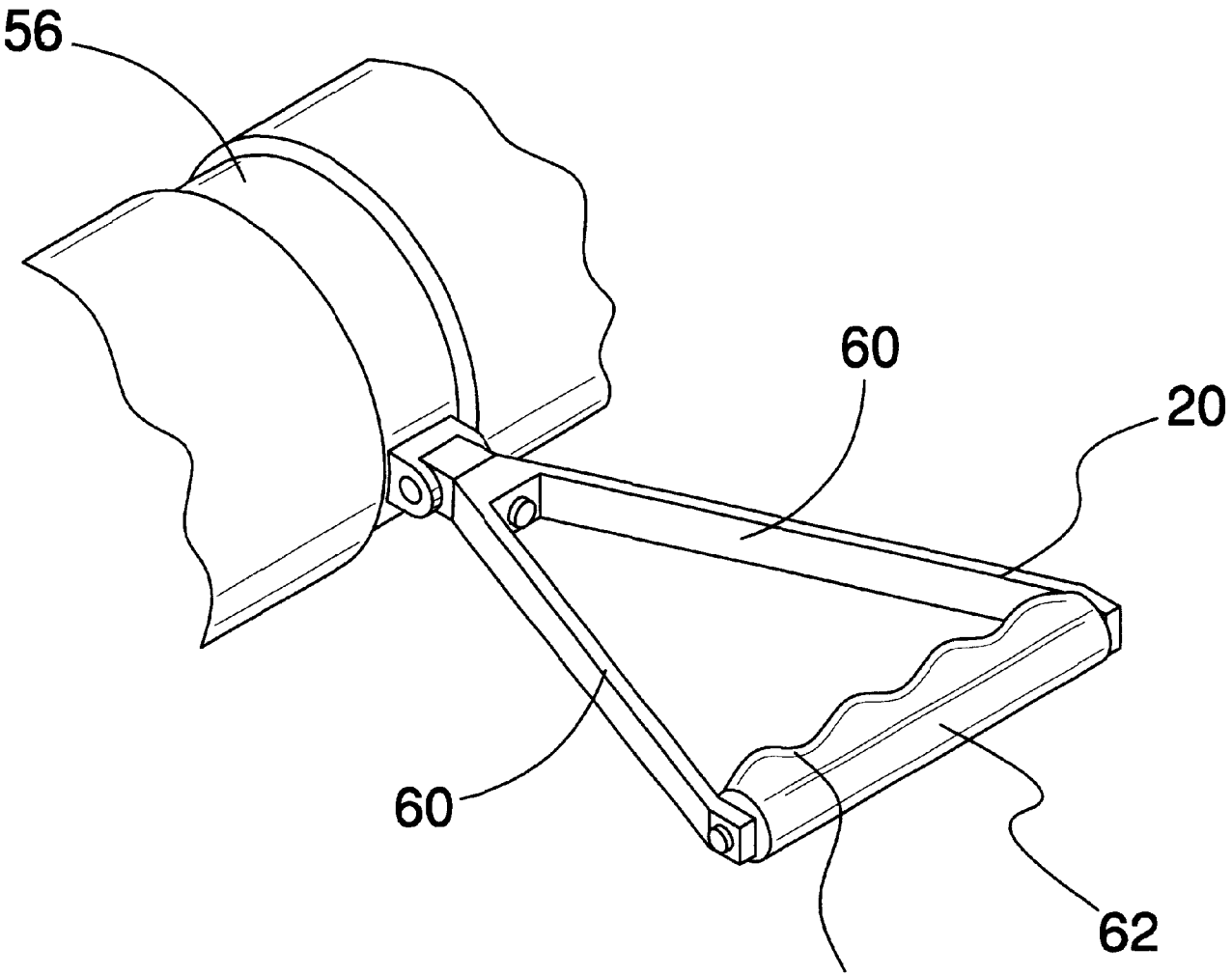
FIG. 3 is a perspective view of the present invention.

With reference now to the drawings, and in particular to FIGS. 1 through 3 thereof, a new tactical weapon embodying the principles and concepts of the present invention and generally designated by the reference numeral 10 will be described.

As best illustrated in FIGS. 1 through 3, the tactical weapon 10 generally includes a firearm assembly 12 that is adapted for firing ammunition. The firearm assembly 12 has a stock member 14. The stock member 14 is adapted for facilitating supporting of the firearm assembly 12 by a user. The stock member 14 has a butt portion 16. The butt portion 16 is coupled to a main portion 18 of the stock member 14 such that the butt portion 16 is selectively positionable with respect to the main portion 18 of the stock member 14. The butt portion 16 is adapted for permitting the user to position the firearm assembly 12 around an object. A handle member 20 is coupled to the firearm assembly 12. The handle member 20 is selectably positionable with respect to the firearm assembly 12 such that the handle member is adapted for permitting the user to position the firearm assembly 12 around the object.

The firearm assembly 12 has a video assembly 22. The video assembly 22 is adapted for permitting the user to view targets when the firearm assembly 12 is positioned around the object.

The video assembly 22 has a camera assembly 24 and a display assembly 26. The camera assembly 24 is operationally coupled to the display assembly 26. A longitudinal axis of the camera assembly 24 is aligned with a longitudinal axis of a barrel 28 of firearm assembly 12. The camera assembly 24 transmits images viewed by the camera assembly 24 to the display assembly 26. The display assembly 26 is adapted for displaying images transmitted by the camera assembly 24.

The camera assembly 24 of the video assembly 22 is coupled to the main portion 18 of the stock member 14. The display assembly 26 of the video assembly 22 is coupled to the butt portion 16 of the stock member 14 such that the display assembly 26 is adapted for permitting the user to view what the camera assembly 24 views when the firearm assembly 12 is positioned around the object.

A laser pointing assembly 30 is coupled to the firearm assembly 12. The laser pointing assembly 30 is adapted for emitting a laser directed towards a target when the firearm assembly 12 is aimed at the target. The video assembly 22 is adapted for permitting the user to view the laser for facilitating designating the target when the firearm assembly 12 is positioned around the object.

The firearm assembly 12 has a receiver assembly 32. The receiver assembly 32 is coupled to the barrel 28 of the firearm assembly 12. The receiver assembly 32 is adapted for handling the ammunition and firing ammunition. The barrel 28 is adapted for guiding the ammunition towards a target.

The firearm assembly 12 has at least one magazine member 34. The magazine member 34 is selectively couplable to the receiver portion 36 of the firearm assembly, 12. The magazine member 34 is adapted for holding multiple rounds of ammunition and supplying the rounds to the receiver portion 36 for firing from the firearm assembly 12.

The receiver portion 36 has an ejection port 38. The ejection port 38 of the receiver portion 36 is positioned through a side face 40 of the receiver portion 36. The ejection port 38 is adapted for permitting the receiver portion 36 to eject casings from the ammunition when the receiver portion 36 has fired the ammunition.

The stock member 14 has a primary trigger 42. The primary trigger 42 is operationally coupled to the receiver assembly 32 such that the primary trigger 42 is actuatable by a finger of the user for actuating the receiver assembly 32 to fire the ammunition.

The stock member 14 has a grip portion 44. The grip portion 44 extends downwardly from the main portion 18 of the stock member 14. The grip portion 44 is adapted for engaging a hand of the user for supporting the firearm assembly 12 when the user uses the firearm assembly 12. The user positions the primary trigger 42 adjacent to the grip portion 44 for facilitating actuating of the primary trigger 42.

The butt portion 16 of the stock member 14 has a secondary trigger 46. The secondary trigger 46 is operationally coupled to the receiver portion 36 such that the secondary trigger 46 is actuatable by a finger of the user for actuating the receiver assembly 32 to fire the ammunition when the firearm assembly 12 is positioned around the object.

The butt portion 16 of the stock member 14 has a pair of support arms 48. Each of the support arms 48 is hingably coupled to the main portion 18 of the stock member 14 for permitting the butt portion 16 to be rotated with respect to the main portion 18 of the stock member 14. A shoulder support member 49 is coupled between a free end 50 of each of the support arms 48 such that the shoulder support member 49 is adapted for bracing against a shoulder of the user when the user is firing the fireman assembly 12.

The butt portion 16 of the stock member 14 has a bracing member 52. The bracing member 52 is coupled to an intermediate portion 54 of each of the support arms 48. The bracing member 52 is adapted for receiving the hand of the user when the firearm assembly is positioned around the object. The user positions the secondary trigger 46 adjacent to the bracing member 52 for facilitating actuation of the secondary trigger 46.

The handle member 20 has a collar 56. The collar 56 is rotatably coupled around the barrel 28 of the firearm assembly 12. The handle member 20 has a gripping portion 58 pivotally coupled to the collar 56. The gripping portion 58 is adapted to be gripped by the hand of the user when the firearm assembly 12 is positioned around the object.

The gripping portion 58 of the handle member 20 has a pair of handle arms 60. Each of the handle arms 60 is pivotally coupled to the collar 56. A gripping member 62 is positioned between a distal end of each of the handle arms 60 such that the gripping member 62 is adapted for is gripped by the hand of the user when the firearm assembly 12 is positioned around the object.

In use, the user would utilize the hinged stock and swivel handle/tripod could be use/d to point the weapon around or over a wall or other cover. The video camera and LCD screen would allow the user to have a clear view in any direction the weapon is pointed. For night vision capability, a companion infrared illuminator could be used to obtain usable camera video in complete darkness.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tactical weapon comprising:

a firearm assembly being adapted for firing ammunition, said firearm assembly having a stock member, said stock member being adapted for facilitating supporting of said firearm assembly by a user, said stock member having a butt portion, said butt portion being coupled to a main portion of said stock member such that said butt portion is selectively positionable with respect to said main portion of said stock member, said butt portion being adapted for permitting the o position said firearm assembly around an object;

a handle member being coupled to said firearm assembly, said handle member being selectably positionable with respect to said firearm assembly such that said handle member is adapted for permitting the user to position said firearm assembly around the object; and said handle member having a collar, said collar being rotatably coupled around a barrel of said firearm assembly, said handle member having a gripping portion pivotally coupled to said collar such that said collar permits rotational adjustment of said gripping portion around said barrel without having to remove said handle member from said firearm assembly when the user is positioning said firearm assembly around the object, said gripping portion being adapted for being gripped by the hand of the user when said firearm assembly is positioned around the object.

2. The tactical weapon as set forth in claim 1, further comprising:

said firearm assembly having a video assembly, said video assembly being adapted for permitting the user to view targets when said firearm assembly is positioned around the object.

3. The tactical weapon as set forth in claim 2, further comprising:

said video assembly having a camera assembly and a display assembly, said camera assembly being operationally coupled to said display assembly, a longitudinal axis of said camera assembly being aligned with a longitudinal axis of a barrel of firearm assembly, said camera assembly transmitting images viewed by said camera assembly to said display assembly, said display assembly being adapted for displaying images transmitted by said camera assembly.

4. The tactical weapon as set forth in claim 3, further comprising:

said camera assembly of said video assembly being coupled to said main portion of said stock member, said display assembly of said video assembly being coupled to said butt portion of said stock member such that said display assembly is adapted for permitting the user to view what is being viewed by said camera assembly when said firearm assembly is positioned around the object.

5. The tactical weapon as set forth in claim 2, further comprising:

a laser pointing assembly being coupled to said firearm assembly, said laser pointing assembly being adapted for emitting a laser directed towards a target when said firearm assembly is aimed at the target, said video assembly being adapted for permitting the user to view the laser for facilitating designating the target when said firearm assembly is positioned around the object.

6. The tactical weapon as set forth in claim 1, further comprising:

said firearm assembly having a receiver assembly, said receiver assembly being coupled to a barrel of said firearm assembly, said receiver being adapted for handling the ammunition and firing ammunition, said barrel being adapted for guiding the ammunition towards a target.

7. The advanced tactical weapon as set forth in claim 6, further comprising:

said firearm assembly having at least one magazine member, said magazine member being selectively couplable to said receiver portion of said firearm assembly, said magazine member being adapted for holding multiple rounds of ammunition and supplying the rounds to said receiver portion for firing from said firearm assembly.

8. The advanced tactical weapon as set forth in claim 6, further comprising:

said receiver portion having an ejection port, said ejection port of said receiver portion being positioned through a side face of said receiver portion, said ejection port being adapted for permitting said receiver portion to eject casings from the ammunition when said receiver portion has fired the ammunition.

9. The advanced tactical weapon as set forth in claim 7, further comprising:

said stock member having a primary trigger, said primary trigger being operationally coupled to said receiver assembly such that said primary trigger is actuatable by a finger of the user for actuating said receiver assembly to fire the ammunition.

10. The advanced tactical weapon as set forth in claim 9, further comprising:

said stock member having a grip portion, said grip portion extending downwardly from said main portion of said stock member, said grip portion being adapted for engaging a hand of the user for supporting said fire arm assembly when said firearm assembly is used by the user, said primary trigger being positioned adjacent to said grip portion for facilitating actuating of said primary trigger by the user.

11. The advanced tactical weapon as set forth in claim 6, further comprising:

said butt portion of said stock member having a secondary trigger, said secondary trigger being operationally coupled to said receiver portion such that said primary trigger is actuatable by a finger of the user for actuating said receiver assembly to fire the ammunition when said firearm assembly is positioned around the object.

12. The advanced tactical weapon as set forth in claim 11, further comprising:

said butt portion of said stock member having a pair of support arms, each of said support arms being hingably coupled to said main portion of said stock member for permitting said butt portion to be rotated with respect to said main portion of said stock member, a shoulder support member being coupled between a free end of each of said support arms such that said shoulder support member is adapted for bracing against a shoulder of the user when the user is firing said firearm assembly.

13. The advanced tactical weapon as set forth in claim 12, further comprising:

said butt portion of said stock member having a bracing member, said bracing member being coupled to an intermediate portion of each of said support arms, said bracing member being adapted for receiving the hand of the user when said firearm assembly is positioned around the object, said secondary trigger being positioned adjacent to said bracing member for facilitating actuation of said secondary trigger by the user.

14. The advanced tactical weapon as set forth in claim 1, further comprising:

said gripping portion of said handle member having a pair of handle arms, each of said handle arms being pivotally coupled to said collar, a gripping member being positioned between a distal end of each of said handle arms such that said gripping member is adapted for being gripped by the hand of the user when said firearm assembly is positioned around the object.

15. A tactical weapon comprising:

a firearm assembly being adapted for firing ammunition, said firearm assembly having a stock member, said stock member being adapted for facilitating supporting of said firearm assembly by a user, said stock member having a butt portion, said butt portion being coupled to a main portion of said stock member such that said butt portion is selectively positionable with respect to said main portion of said stock member, said butt portion being adapted for permitting the user to position said firearm assembly around an object; and a handle member being coupled to said firearm assembly, said handle member being selectably positionable with respect to said firearm assembly such that said handle member is adapted for permitting the user to position said firearm assembly around the object;

wherein said firearm assembly has a video assembly, said video assembly being adapted for permitting the user to view targets when said firearm assembly is positioned around the object;

wherein said video assembly has a camera assembly and a display assembly, said camera assembly being operationally coupled to said display assembly, a longitudinal axis of said camera assembly being aligned with a longitudinal axis of a barrel of firearm assembly, said camera assembly transmitting images viewed by said camera assembly to said display assembly, said display assembly being adapted for displaying images transmitted by said camera assembly;

wherein said camera assembly of said video assembly is coupled to said main portion of said stock member, said display assembly of said video assembly being coupled to said butt portion of said stock member such that said display assembly is adapted for permitting the user to view what is being viewed by said camera assembly when said firearm assembly is positioned around the object;

wherein a laser pointing assembly is coupled to said firearm assembly, said laser pointing assembly being adapted for emitting a laser directed towards a target when said firearm assembly is aimed at the target, said video assembly being adapted for permitting the user to view the laser for facilitating designating the target when said firearm assembly is positioned around the object;

wherein said firearm assembly has a receiver assembly, said receiver assembly being coupled to a barrel of said firearm assembly, said receiver being adapted for handling the ammunition and firing ammunition, said barrel being adapted for guiding the ammunition towards a target;

wherein said firearm assembly has at least one magazine member, said magazine member being selectively couplable to said receiver portion of said firearm assembly, said magazine member being adapted for holding multiple rounds of ammunition and supplying the rounds to said receiver portion for firing from said firearm assembly;

wherein said receiver portion has an ejection port, said ejection port of said receiver portion being positioned through a side face of said receiver portion, said ejection port being adapted for permitting said receiver portion to eject casings from the ammunition when said receiver portion has fired the ammunition;

wherein said stock member has a primary trigger, said primary trigger being operationally coupled to said receiver assembly such that said primary trigger is actuatable by a finger of the user for actuating said receiver assembly to fire the ammunition;

wherein said stock member has a grip portion, said grip portion extending downwardly from said main portion of said stock member, said grip portion being adapted for engaging a hand of the user for supporting said fire arm assembly when said firearm assembly is used by the user, said primary trigger being positioned adjacent to said grip portion for facilitating actuating of said primary trigger by the user;

wherein said butt portion of said stock member has a secondary trigger, said secondary trigger being operationally coupled to said receiver portion such that said secondary trigger is actuatable by a finger of the user for actuating said receiver assembly to fire the ammunition when said firearm assembly is positioned around the object;

wherein said butt portion of said stock member has a pair of support arms, each of said support arms being hingably coupled to said main portion of said stock member for permitting said butt portion to be rotated with respect to said main portion of said stock member, a shoulder support member being coupled between a free end of each of said support arms such that said shoulder support member is adapted for bracing against a shoulder of the user when the user is firing said firearm assembly;

wherein said butt portion of said stock member has a bracing member, said bracing member being coupled to an intermediate portion of each of said support arms, said bracing member being adapted for receiving the hand of the user when said firearm assembly is positioned around the object, said secondary trigger being positioned adjacent to said bracing member for facilitating actuation of said secondary trigger by the user;

wherein said handle member has a collar, said collar being rotatably coupled around a barrel of said firearm assembly, said handle member having a gripping portion pivotally coupled to said collar such that said collar permits rotational adjustment of said gripping portion around said barrel without having to remove said handle member from said firearm assembly when the user is positioning said firearm assembly around the object, said gripping portion being adapted for being gripped by the hand of the user when said firearm assembly is positioned around the object;

wherein said gripping portion of said handle member has a pair of handle arms, each of said handle arms being pivotally coupled to said collar, a gripping member being positioned between a distal end of each of said handle arms such that said gripping member is adapted for being gripped by the hand of the user when said firearm assembly is positioned around the object.

* * * * *